United States Patent [19]

Anzai

[11] 4,052,206

[45] Oct. 4, 1977

[54] ELECTROPHOTOGRAPHY

[75] Inventor: Masayasu Anzai, Hitachi, Japan

[73] Assignee: Hitachi, Ltd., Japan

[21] Appl. No.: 628,492

[22] Filed: Nov. 3, 1975

[30] Foreign Application Priority Data

Nov. 7, 1974 Japan ..... 49-128418

[51] Int. Cl.[2] ..... G03Q 13/22

[52] U.S. Cl. ..... 96/1 R; 355/3 R; 346/160

[58] Field of Search ..... 96/1 R; 355/3 R; 346/74 P

[56] References Cited

U.S. PATENT DOCUMENTS

| | | | |
|---|---|---|---|
| 3,457,070 | 7/1969 | Watanabe et al. | 96/1 R X |
| 3,615,395 | 10/1971 | Yamaji et al. | 355/3 R X |
| 3,653,064 | 3/1972 | Inoue et al. | 346/74 P X |
| 3,666,364 | 5/1972 | Marushima | 96/1 R X |
| 3,676,117 | 7/1972 | Kinoshita | 96/1 R |
| 3,677,751 | 7/1972 | Ohta et al. | 96/1 R |
| 3,730,709 | 5/1973 | Kinoshita et al. | 96/1 R X |
| 3,775,104 | 11/1973 | Matsumoto et al. | 96/1 R |
| 3,776,627 | 12/1973 | Ohnishi et al. | 96/1 R X |
| 3,797,928 | 3/1974 | Kinoshita et al. | 355/3 R |
| 3,930,850 | 1/1976 | Matsumoto et al. | 96/1 R X |

*Primary Examiner*—Roland E. Martin, Jr.
*Attorney, Agent, or Firm*—Craig & Antonelli

[57] ABSTRACT

Electrophotography which employs a recording medium prepared by providing a photoconductor layer and a transparent electrical insulator layer on a support. In the electrophotography, a latent charge image is formed on the surface of the insulator layer of the recording medium by the steps of uniformly applying charges of one polarity to the recording medium in a dark place, exposing the recording medium to light reflected from an original image while applying charges of the same polarity to the recording medium at the same time, applying charges of opposite polarity to the recording medium in the dark place, and uniformly exposing the entire surface of the insulator layer of the recording medium to light.

10 Claims, 18 Drawing Figures

ELECTROPHOTOGRAPHY

BACKGROUND OF THE INVENTION

1. Field of the Invention

This invention relates to electrophotography, and more particularly to an electrophotographic process for forming a latent charge image on one surface of a recording medium.

2. Description of the Prior Art

Electrophotography used for forming a latent charge image on a recording medium is generally classified into two types. In one type of electrophotography, such a latent charge image is formed directly on one surface of a photoconductor layer, while in the other type of electrophotography, such a latent charge image is formed on the surface of an electrical insulator layer provided on one surface of a photoconductor layer.

A plurality of latent image forming processes have been proposed for the latter type of electrophotography. One of the proposed processes employes a recording medium which is prepared by disposing a photoconductor layer on a conductive support and covering the photoconductor layer with a transparent electrical insulator layer. In the first step of this process, the surface of the transparent insulator layer is uniformly charged with charges of one polarity in a dark place. Generally, negative and positive charges are applied respectively when the photoconductor is of n-type and p-type. Then, an optical image is projected on the recording medium by exposing the recording medium to light reflected from the original image. As a result, the photoconductor layer is rendered conductive in the areas exposed to light, and the charges migrate to the boundary between the insulator layer and the photoconductor layer in these areas. Charges of opposite polarity are then applied in the dark places so as to substantially eliminate the surface charges in the areas exposed to light. As a result, the charge density on the surface of the insulator layer portions not exposed to light becomes higher than that on the surface of the insulator layer portions exposed to light. When, finally, the entire surface of the insulator layer is uniformly exposed to light, a charge distribution corresponding to the amount of surface charges is produced at the boundary between the insulator layer and the photoconductor layer. Thus, a potential distribution corresponding to the surface charges can be obtained. However, this latent image forming process has been defective in that the density of the developed image is not satisfactory and fogging tends to occur in the developed image since the contrast of the latent image potentials is not so marked and application of the charges of opposite polarity is difficult to control resulting in unstable charging.

SUMMARY OF THE INVENTION

It is an object of the present invention to provide an electrophotographic process which is capable of increasing the contrast of a latent charge image.

Another object of the present invention is to provide an electrophotographic process which facilitates controlled application of charges of polarity opposite to that initially applied.

Still another object of the present invention is to provide an electrophotographic process which is suitable for high-speed recording.

Other objects of the present invention will become apparent from the following detailed description of preferred embodiments thereof.

The present invention relates to an electrophotographic process of the type used for forming a latent charge image on a recording medium consisting of a support, a photoconductor layer and a transparent electrical insulator layer by the steps of uniformly applying charges of one polarity to the recording medium, exposing the recording medium to light reflected from an original image, applying charges of opposite polarity to the recording medium, and then uniformly exposing the recording medium to light, and is featured by the fact that the exposure of the recording medium to light reflected from the original image is carried out while applying charges of the same polarity to the recording medium at the same time.

DETAILED DESCRIPTION OF THE PREFERRED EMBODIMENTS

Referring to FIGS. 1A to 1D, a transparent electrical insulator layer 1, a photoconductor layer 2 and a conductive support 3 are bonded together to constitute a recording medium. The material of the transparent insulator layer 1 may be polyethylene, polyethylene terephthalate, trinitro cellulose or the like. The material of the photoconductor layer 2 may be zinc oxide (ZnO), titanium oxide ($TiO_2$), cadmium sulfide (CdS) or the like dispersed in a resin such as an acrylic resin, polyester or polyvinyl chroride. The material of the photoconductor layer 2 may also be selenium (Se), a selenium (Se)-tellurium (Te) compound, or an organic photoconductor. The material of the conductive support 3 may be aluminum (Al), copper (Cu), brass, nesa glass, organic conductor or the like. This support 3 need not necessarily be conductive depending on the property of the photoconductor layer 2 and the manner of charging, but it is generally preferably conductive. It is preferable for the property of the photoconductor layer to be charged suitably in the both polarities at the condition of nonexistence of the insulator layer 1. Further, it is necessary that the photosensitivity to at least one polarity can respond suitably to the light image to be formed.

Figure 1A:
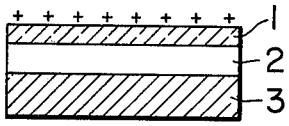
FIGS. 1A to 1D show successive steps of an embodiment of the latent image forming process according to the present invention.
Figure 1B:
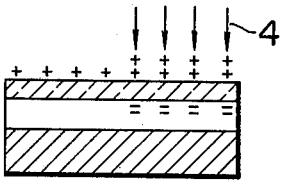
Figure 1C:
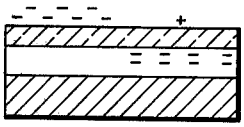
Figure 1D:
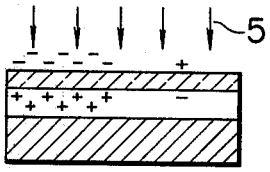

One form of the process of the present invention for forming a latent charge image using such a recording medium will be described with reference to FIGS. 1A to 1D. Referring first to FIG. 1A, the recording medium is placed in a dark place and charges of one polarity are uniformly applied to the surface of the insulator layer 1. This uniform charging can be performed by a corona charger of the type in which a D.C. voltage of 6 to 7 kilovolts is applied across wires to produce a corona discharge. In this charging step, the surface of the insulator layer 1 is charged to have a surface potential of about 2,000 volts. Then, as shown in FIG. 1B, the recording medium is exposed to rays of light 4 reflected from an original image, and at the same time, charges of the same polarity as the initially applied polarity are applied to the recording medium for re-charging. The intensity of light used for the exposure is about 10 lx-sec, and the re-charging can be carried out by the same corona charge or another 6–7 kilovolt corona charger. As a result of the exposure and re-charging step shown in FIG. 1B, the exposed areas of the surface of the insulator layer 1 are charged with additional charges of the amount sufficient for the compensation of the reduction of the surface potential due to the charges appearing at the boundary between the insulator layer 1 and the photoconductor layer 2, so that the charge density in these areas can be increased. Then, as shown in FIG. 1C, corona discharge of opposite polarity is applied to the surface of the recording medium in the dark place for charging the surface with charges of opposite polarity. A corona charger generating a corona of opposite polarity is used in this step. The extent of charging in the step shown in FIG. 1C is such that after a next exposure on the total surface the surface potential remaining on the exposed areas is about 100 volts. In this case, before the exposure of the total surface the total surface potential oppositely charged is about 2,000 volts. The extent of charging in this charging step may be controlled by controlling the scanning rate (time) of the corona charger. Finally, as shown in FIG. 1D, rays of light 5 are uniformly directed to the total surface of the recording medium to provide a latent image having a potential distribution corresponding to the amount of the charges remaining on the surface of the insulator layer 1. The intensity of light used for this exposure may be about 50 lx-sec. A visible image can be obtained by developing the latent image with a positive or negative toner.

Figure 2:
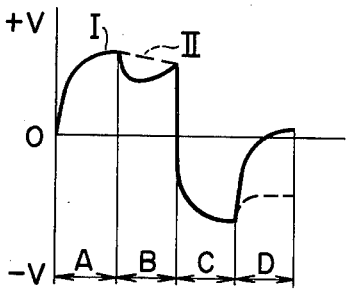
FIG. 2 is a graph showing patential variations in an optical image formed on the recording medium by the steps shown in FIGS. 1A to 1D.

FIG. 2 shows potential variations on the surface of the insulator layer 1 of the recording medium during the process above described, and the regions A to D in FIG. 2 correspond to the respective steps shown in FIGS. 1A to 1D. The solid curve I in FIG. 2 represents potential variations in the bright areas of the optical image, and the dotted curve II represents potential variations in the dark areas of the optical image. By virtue of the simultaneous recharging and exposure employed in the process according to the present invention, the charges finally remaining in the dark areas of the optical image are more than heretofore, and the potential contrast is about 1.5 to 2 times that obtained with prior art processes. The surface potential oppositely charged after an end of the same time-exposure with charging has more uniformity and quickness than the conventional system so that a light image becomes substantially the same without regard for existence and non-existence of the exposure or illumination.

Difficulty may be frequently encountered in maintaining a stable saturation potential when the D.C. corona charger is used for the charging step shown in FIG. 1C in which the charges of opposite polarity are applied to the recording medium. In such a case, A.C. corona charger to generate an asymmetrical A.C. corona may be used for charging with a plasmic corona containing many charges of opposite polarity, due to the fact that such A.C. corona charger can be relatively easily controlled for stabilizing the saturation potential.

Figure 3A:
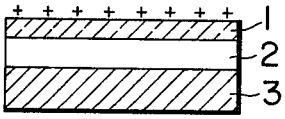
FIGS. 3A to 3F show successive steps of another embodiment of the present invention.
Figure 3B:
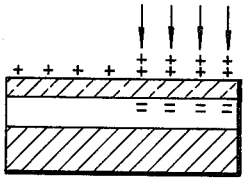
Figure 3C:
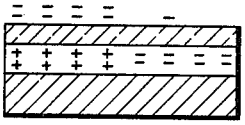
Figure 3D:
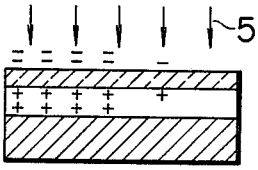
Figure 3E:
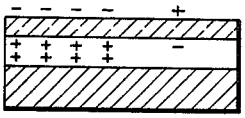
Figure 3F:
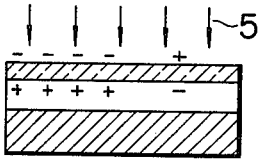

Another embodiment of the process according to the present invention is shown in FIGS. 3A to 3F. The steps shown in FIGS. 3A to 3D are substantially the same as those shown in FIGS. 1A to 1D except that the charges of opposite polarity are applied in a greater amount in FIG. 3C than in FIG. 1C. Application of such excessive charges of opposite polarity is advantageous in that the corona discharge can be more easily controlled. However, the steps shown in FIGS. 3A to 3D are incomplete in that the charges of the same polarity appear in both the exposed areas and the non-exposed areas resulting in fogging of the developed image. Therefore, two additional steps as shown in FIGS. 3E and 3F are required in the second embodiment of the present invention.

Figure 4:
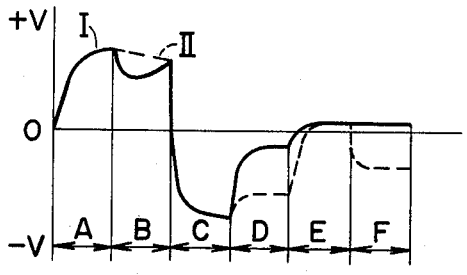
FIG. 4 is a graph showing potential variations in an optical image formed on the recording medium by the steps shown in FIGS. 3A to 3F.

In the process presently described, the recording medium having the charge image obtained after the step shown in FIG. 3D is further exposed to an A.C. corona in a dark place as shown in FIG. 3E. In the step shown in FIG. 3C, the exposed areas after the exposure on the total surface are charged with the charges of opposite polarity to provide a potential of 200 to 300 volts in the exposed areas. In the step shown in FIG. 3E, the potential in the exposed areas is reduced substantially to zero by the A.C. corona. Such potential reduction is easily attained since the A.C. corona charger can be relatively easily controlled. After the step shown in FIG. 3E, rays of light 5 are uniformly applied to the entire surface of the insulator layer 1 so that a latent image having a potential distribution corresponding to the amount of the charges can be produced on the surface of the insulator layer 1. FIG. 4 shows potential variations on the recording medium processed by the process shown in FIGS. 3A to 3F. In FIG. 4 too, the regions A to F correspond to the respective steps shown in FIGS. 3A to 3F, and the solid curve I and dotted curve II represent respectively the bright and dark areas of the optical image.

The recording medium must have a high sensitivity to light in order to attain recording at a high speed. This is realized by employing a photoconductor having a high sensitivity to form the photoconductor layer 2. However, such a photoconductor has such an inherent disadvantage that the rate of dark attenuation is high.

FIGS. 5A to FIG. 5D show a modification of the process shown in FIGS. 1A to 1D. This modification is suitable for high-speed recording.

Figure 5A:
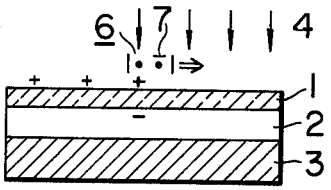
FIGS. 5A to 5D show successive steps of still another embodiment of the present invention.
Figure 5B:
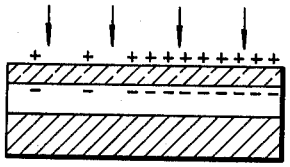
Figure 5C:
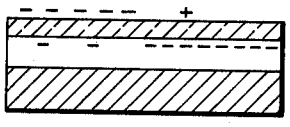
Figure 5D:
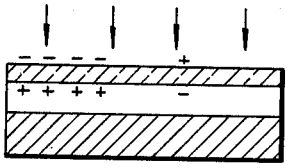

In this modification, the steps shown in FIGS. 1A and 1B are substantially simultaneously carried out in the step shown in FIG. 5A. Referring to FIG. 5A, a corona charger 6 having a light shielding member 7 in the advancing direction thereof is employed to uniformly apply charges to the dark area beneath the light shielding member 7. In FIG. 5C corresponding to FIG. 1C, charges of opposite polarity are similarly applied. However, the surface potential varies incessantly and the desired charging with the charges of opposite polarity cannot be carried out uniformly when the rate of dark attenuation of the photoconductor is great. In this modification, therefore, the entire surface of the insulator layer 1 is uniformly exposed to light for stabilizing the charges as shown in FIG. 5B, and then, the step of charging with the charges of opposite polarity and the step of uniform exposure of the entire surface to light are carried out respectively as shown in FIGS. 5C and 5D. The steps shown in FIGS. 5C and 5D are the same as those shown in FIGS. 1C and 1D respectively.

Figure 6:
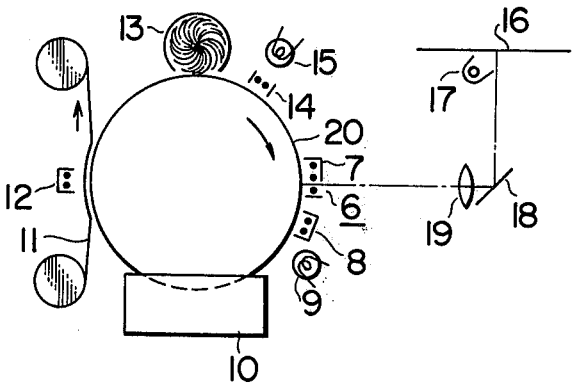
FIG. 6 is a diagrammatic view of an apparatus preferably used for the latent image forming process shown in FIGS. 1A to 1D.

FIG. 6 is a diagrammatic view of a copying apparatus preferably used for carrying out the process shown in FIGS. 1A to 1D.

Referring to FIG. 6, a recording drum 20 is provided with a recording medium consisting of an electrical insulator layer 1, a photoconductor layer 2 and a conductive support 3 similar to that shown in FIG. 1A although the structure thereof is not illustrated in detail. A corona charger 6 is provided with a light shielding member 7, and thus, its structure is similar to that shown in FIG. 5A. Light is emitted from an illuminating light source 17 toward an original image 16 to be reflected from the original image 16 and passes through an optical path consisting of a mirror 18 and a lens 19 to be projected on the surface of the recording drum 20 through an aperture of the corona charger 6 thereby forming an optical image on the surface of the recording drum 20. The recording drum 20 rotates in a direction as shown by the arrow. Thus, after the application of the charges of one polarity by the corona charger 6 and projection of the optical image, the charges of opposite polarity are applied by another corona charger 8, and then, light is uniformly directed from a lamp 9. A latent charge image thus formed on the surface of the recording drum 20 is then converted into a visible image by a developer 10. The visible image is then transfer printed on an image copying sheet 11. An additional corona charger 12 is provided so that this transfer printing can be effectively carried out. The surface of the rotating drum 20 is subsequently cleaned by a cleaning brush 13, and after the residual toner and charges are removed by a charge-removing corona charger 14 and a lamp 15, the next recording is started. The charge-removing corona charger 14 may be either the D.C. type or the A.C. type, and the lamp 15 may be eliminated.

I claim:

1. An electrophotographic process for forming a latent charge image on the surface of a transparent electrical organic insulator layer in a recording medium having a photoconductor layer sandwiched between a conductive support and said organic insulator layer, comprising the steps of a. uniformly applying a D.C. corona charge of one polarity to said surface of said organic insulator layer of said recording medium in the dark;

b. exposing areas of said uniformly D.C. corona charged surface of said organic insulator layer to light reflected from an original image while applying simultaneously a D.C. corona charge of the same polarity as that used in said uniform charging of said surface of said organic insulator layer of step (a);

c. applying a charge of polarity opposite to that used in said steps (a) and (b) to the surface of said organic insulator layer in the dark until an electric potential on the unexposed surface of said organic insulator layer has a charge of polarity opposite to that of steps (a) and (b); and then d. uniformly exposing said charged surface of said organic insulator layer of step (c) to light.

2. An electrophotographic process as claimed in claim 1, wherein the extent of charging in said step (c) is such as to leave a slight charge of the same polarity as that pre-existing in the areas exposed in said step (b).

3. An electrophotographic process as claimed in claim 1, wherein an extent of charging in said step (c) is such as to leave a slight charge of inverted polarity as that of a charge pre-existing in said area exposed in said step (b), e. applying a charge-removing A.C. corona to said surface of said insulator layer after said step (d) thereby restoring a polarity of said charge remaining slightly in said exposed area to an original polarity of step (b), and then f. uniformly exposing said surface of said insulator to light.

4. An electrophotographic process as claimed in claim 1 comprising effecting said steps (a) and (b) substantially simultaneously, and subsequently uniformly exposing an entire surface of said organic insulator layer to light prior to effecting said step (c).

5. An electrophotographic process as claimed in claim 1, wherein said charge of step (a) has a surface potential of about 2,000 volts.

6. An electrophotographic process as claimed in claim 1, wherein the intensity of said light of said (b) is about 10 lx-sec.

7. An electrophotographic process as claimed in claim 1, wherein a resulting charge of polarity opposite to that used in steps (a) and (b) according to step (c) has a surface potential of about 2,000 volts.

8. An electrophotographic process as claimed in claim 1, wherein the extent of charging according to step (c) is such that subsequent to an exposure to light according to step (d), a surface potential remaining on said exposed surface is about 100 volts.

9. An electrophotographic process as claimed in claim 1, wherein the intensity of said light of said step (d) is about 50 lx-sec.

10. An electrophotographic process as claimed in claim 3, wherein a potential in said exposed area is reduced substantially to 0 according to step (e).

* * * * *